US006680431B2

(12) United States Patent
Vanden et al.

(10) Patent No.: US 6,680,431 B2
(45) Date of Patent: Jan. 20, 2004

(54) VIOLIN SHOULDER REST

(75) Inventors: Michael Vanden, Acharacle (GB); Scott Lefton, Melrose, MA (US); Lawrence B. Fishman, Winchester, MA (US)

(73) Assignee: Fishman Transducers, Inc., Wilmington, MA (US)

( * ) Notice: Subject to any disclaimer, the term of this patent is extended or adjusted under 35 U.S.C. 154(b) by 0 days.

(21) Appl. No.: 10/345,840

(22) Filed: Jan. 16, 2003

(65) Prior Publication Data

US 2003/0167896 A1 Sep. 11, 2003

Related U.S. Application Data

(60) Provisional application No. 60/357,784, filed on Feb. 19, 2002, and provisional application No. 60/349,040, filed on Jan. 16, 2002.

(51) Int. Cl.[7] ..... G10D 1/02

(52) U.S. Cl. ..... 84/279; 84/278; 84/280; 84/281

(58) Field of Search ..... 81/279, 280, 281, 81/278, 290

(56) References Cited

U.S. PATENT DOCUMENTS

| | | | | | |
|---|---|---|---|---|---|
| 3,631,754 | A | | 1/1972 | Kun | 84/280 |
| 4,765,219 | A | * | 8/1988 | Alm | 84/726 |
| 5,208,409 | A | * | 5/1993 | Roulet | 84/278 |
| 5,270,474 | A | | 12/1993 | Kun | 84/280 |
| D352,053 | S | * | 11/1994 | Murray | D17/20 |
| D385,292 | S | * | 10/1997 | Kun | D17/20 |
| 6,031,163 | A | * | 2/2000 | Cullum et al. | 84/279 |
| 6,278,044 | B1 | * | 8/2001 | Ruan | 84/279 |
| 6,369,303 | B1 | * | 4/2002 | Hvezda | 84/278 |
| 6,441,292 | B1 | * | 8/2002 | Donnell | 84/723 |

* cited by examiner

*Primary Examiner*—Kimberly Lockett
(74) *Attorney, Agent, or Firm*—Weingarten, Schurgin, Gagnebin & Lebovici LLP

(57) ABSTRACT

A violin shoulder rest that facilitates the optimal positioning of a violin relative to a violin player's body for increased comfort and reduced physical stress, and facilitates the optimal positioning of a microphone relative to the violin to achieve the desired volume and tonal qualities of the sound produced by the instrument. The violin shoulder rest includes an elongated base conformable to a violin player's body, clamping members coupled at opposing ends of the base for clamping the shoulder rest to a violin, and a securement mechanism to secure the respective clamping members to the base. The violin shoulder rest accommodates at least one electrical signal input, and amplification circuitry or other signal processing circuitry for pre-amplifying or otherwise processing the electrical signal input. The violin shoulder rest is configured to mount a positionable microphone subassembly adjacent a respective signal input connector.

37 Claims, 10 Drawing Sheets

VIOLIN SHOULDER REST

CROSS REFERENCE TO RELATED APPLICATIONS

This application claims priority of U.S. Provisional Patent Application No. 60/349,040 filed Jan. 16, 2002 entitled VIOLIN SHOULDER REST, and U.S. Provisional Patent Application No. 60/357,784 filed Feb. 19, 2002 entitled VIOLIN SHOULDER REST.

STATEMENT REGARDING FEDERALLY SPONSORED RESEARCH OR DEVELOPMENT

N/A

BACKGROUND OF THE INVENTION

The present invention relates generally to shoulder rests for use with musical instruments such as violins and similar stringed instruments, and more specifically to a violin shoulder rest configured to mount a positionable microphone, and to accommodate one or more electrical signal inputs.

Violin shoulder rests are known that allow a violin player to rest a violin against his or her body with increased comfort and reduced physical stress while playing the instrument. A conventional violin shoulder rest is disclosed in U.S. Pat. No. 5,270,474 (the "'474 patent") filed Aug. 20, 1990 entitled VIOLIN OR THE LIKE SHOULDER REST. The conventional violin shoulder rest described in the '474 patent includes an elongated base configured to conform to a violin player's shoulder, a pair of clamping members coupled to opposing ends of the base and configured to clamp the shoulder rest to a violin, and a mechanism for securing the respective clamping members to the base, and for allowing limited pivotal movement of the clamping members. The conventional violin shoulder rest allows the violin player to adjust the transverse inclination of the shoulder rest base relative to the violin, thereby facilitating the positioning of the violin to increase the comfort of the violin player while playing the instrument.

In recent years, many violin players have sought to amplify or otherwise electronically process the sound that they produce with their violins. Such violin players typically position themselves and their violins near one or more standalone microphones, which generate electrical signals representative of the sound produced by the instruments. The electrical signals generated by the microphones are normally provided to amplification circuitry or other signal processing circuitry, which subsequently provides amplified or otherwise processed signals to one or more loudspeakers, thereby producing sound having the desired volume and tonal qualities.

One drawback of using a standalone microphone when amplifying and/or conditioning the sound produced by a violin is that it is often difficult to optimally position the microphone relative to the violin. This is typically because violin players rarely remain stationary when playing their instruments. For example, during musical performances, violin players frequently make significant bodily movements to attain the desired emotional impact of a piece. As a result, the violin may significantly deviate from the optimal positioning near the microphone, and the desired amplification and conditioning of the sound may not be achieved.

It would therefore be desirable to have a violin shoulder rest that allows a violin player to rest a violin against his or her body with increased comfort and reduced physical stress while playing the instrument. Such a violin shoulder rest would facilitate the optimal positioning of the violin relative to the violin player's body. It would also be desirable to have a mechanism for facilitating the optimal positioning a microphone near the violin during a musical performance.

BRIEF SUMMARY OF THE INVENTION

In accordance with the present invention, a violin shoulder rest is disclosed that not only facilitates the optimal positioning of a violin relative to a violin player's body for increased comfort and reduced physical stress, but also facilitates the optimal positioning of a microphone relative to the violin to achieve the desired volume and tonal qualities of the sound produced by the instrument. The presently disclosed violin shoulder rest is configured to mount a positionable microphone near the violin, and to accommodate electronic circuitry for amplifying and/or otherwise processing electrical signals provided by the microphone and optionally at least one more electrical signal input device.

In one embodiment, the violin shoulder rest includes an elongated base configured to be conformable to a violin player's body, a pair of clamping members coupled at opposing ends of the base and configured to clamp the shoulder rest to a violin, and a securement mechanism configured to secure the respective clamping members to the base. The securement mechanism is further configured to allow pivotal movement of the clamping members to facilitate the optimal positioning of the violin relative to the violin player's body, and linear movement of the clamping members for fine adjustment of the spacing between the clamps, and the spacing between each clamp and the elongated base.

The violin shoulder rest is configured to accommodate at least one electrical signal input, and optional amplification circuitry or other signal processing circuitry for pre-amplifying or otherwise processing the electrical signal input. The elongated base of the violin shoulder rest includes a pair of substantially rigid hollow enclosures at opposing ends of the base, and a flexible hollow section disposed between the opposing enclosures. The opposing hollow enclosures are configured to house the amplification and/or signal processing circuitry, which may include at least one printed circuit board and one or more active/passive integrated and/or discrete electrical/electronic components. The opposing enclosures are further configured to accommodate a plurality of connectors for receiving the electrical signal input and for providing at least one electrical signal output, and one or more controls for mixing a plurality of electrical signal inputs and/or for adjusting sound volume and tone. A respective hollow enclosure may be configured to house a wireless transmitter circuit to obviate the need for a cable to convey the processed signal output. The flexible section between the rigid enclosures not only allows the violin shoulder rest to conform to the contours of the violin player's body, but also serves as a conduit for conductors passing between the circuitry, connectors, and controls disposed within the opposing rigid enclosures. At least one of the opposing enclosures is further configured to accommodate a compartment for housing a battery to power the active electrical/electronic components. The connectors, the controls, and the battery compartment are optimally situated relative to the rigid enclosures for easy access by the violin player. Moreover, a foam pad is attached to the elongated base of the violin shoulder rest for enhanced violin playing comfort.

The violin shoulder rest is further configured to mount a positionable microphone subassembly adjacent a respective signal input connector. The microphone subassembly includes a flexible boom, a microphone attached to the distal end of the boom, and a connector coupled to the opposing end of the boom and configured to connect to the signal input connector. In the preferred embodiment, the flexible boom is configured as a conduit for conductors passing between the microphone and the microphone connector. Further, the boom has length and flexibility characteristics that allow the microphone to be easily and optimally positioned near the violin, for example, adjacent one of the violin sound holes. A foam cover may be placed over the microphone to minimize the adverse effects of wind and vibration on the amplified violin sound.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which.

DETAILED DESCRIPTION OF THE INVENTION

U.S. Provisional Patent Application No. 60/349,040 filed Jan. 16, 2002 entitled VIOLIN SHOULDER REST, and U.S. Provisional Patent Application No. 60/357,784 filed Feb. 19, 2002 entitled VIOLIN SHOULDER REST, are incorporated herein by reference.

A violin shoulder rest is provided that facilitates the optimal positioning of a violin relative to the violin player's body, and also facilitates the optimal positioning of a microphone relative to the violin. The violin shoulder rest includes a mount for the positionable microphone, and an elongated base that conforms to the contours of the violin player's shoulder, and accommodates optional electronic circuitry that may be employed to amplify or otherwise process electrical signals provided by the microphone.

Figure 1:
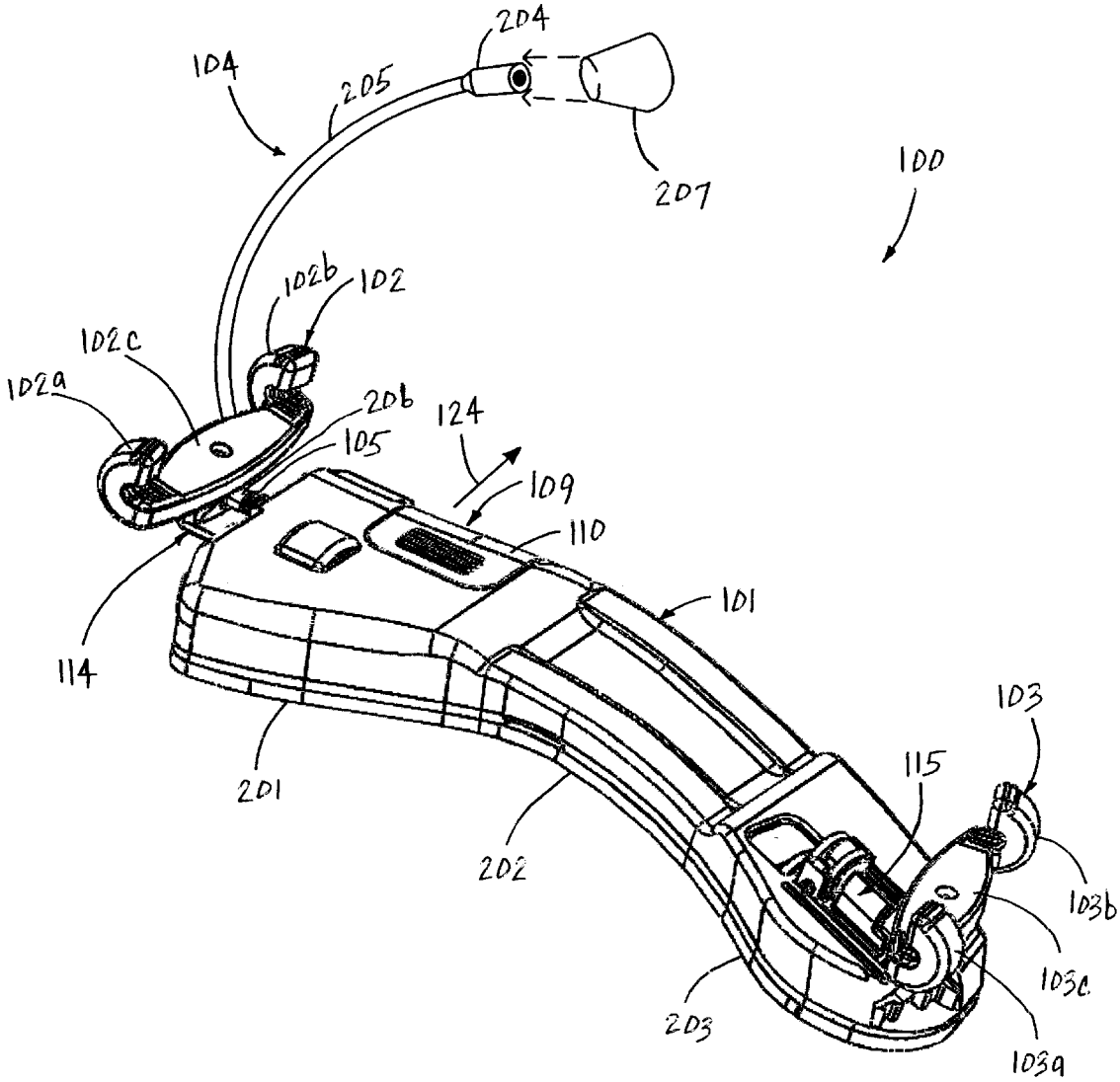
FIG. 1 is a first perspective view of a violin shoulder rest including an elongated base, first and second opposing clamping members, and a positionable microphone subassembly, according to the present invention.
Figure 8:
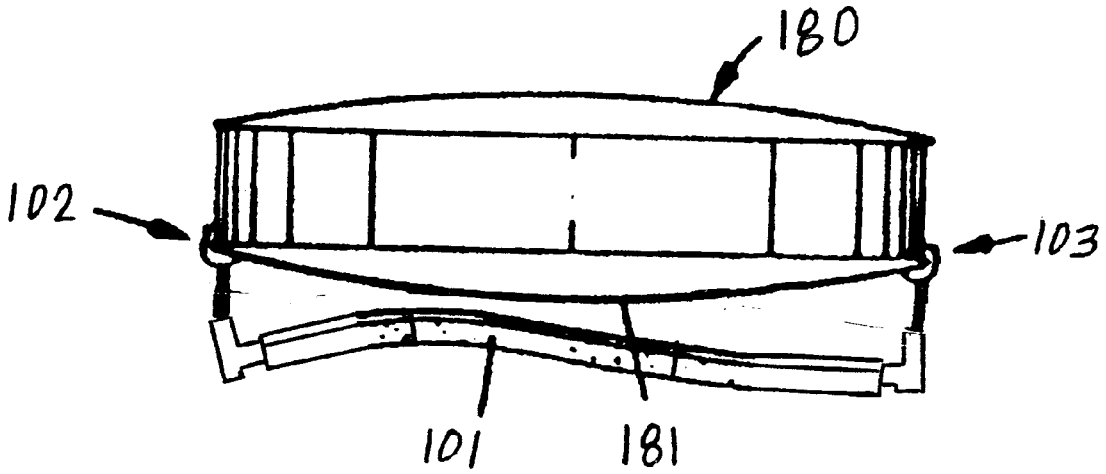
FIG. 8 is an end view of a violin illustrating how the violin shoulder rest of FIG. 1 is attached to the instrument.

FIG. 1 depicts a first perspective view of an illustrative embodiment of a violin shoulder rest 100, in accordance with the present invention. In the illustrated embodiment, the violin shoulder rest 100 includes a base 101, a plurality of clamping members 102–103 secured at opposing ends of the base 101, and a microphone subassembly 104. The base 101 is elongated substantially transversely relative to a violin 180 (see FIG. 8), when the violin shoulder rest 100 is attached to the instrument. Further, the base 101 is configured to be conformable to a violin player's shoulder (not shown). Specifically, the base 101 (see FIG. 1) has the shape of a relatively shallow curvature and a flexible section 202 disposed substantially midway between the opposing ends of the base 101 to allow the base 101 to flexibly conform to the contours of the violin player's shoulder.

As shown in FIG. 1, the clamping member 102 includes a pair of curved clamping fingers 102*a*–102*b* and a violin supporting portion 102*c* disposed between the fingers 102*a*–102*b*. Similarly, the clamping member 103 includes a pair of curved clamping fingers 103*a*–103*b*, and a violin supporting portion 103*c* disposed between the fingers 103*a*–103*b*. The clamping members 102–103 are configured to securely clamp the violin shoulder rest 100 to edges of the underside 181 of the violin 180 (see FIG. 8). In the preferred embodiment, the clamping members 102–103 are either rubberized or provided with a soft coating or respective pads to engage the violin 180 without scratching the violin's finish or otherwise damaging the instrument's surface. The soft coating or respective pads on the clamping members 102–103 also provide the violin with a degree of isolation from vibrations that may be imparted to the violin shoulder rest 100. The clamping members 102–103 are secured at the opposing ends of the base 101 by securement mechanisms 114–115, respectively.

In the presently disclosed embodiment, the microphone subassembly 104 is mounted at an adjustable angle relative to the elongated base 101 adjacent the securement mechanism 114 of the clamping member 102. The microphone subassembly 104 includes a microphone 204, a flexible boom 205, and a connector 206. In the illustrated embodiment, the flexible boom 205 is configured as a conduit for conductors passing between the microphone 204 and the microphone connector 206, which may comprise a coaxial connector or any other suitable type of electromechanical connector. It is noted that the violin shoulder rest 100 includes a signal input connector 105 (see also FIG. 2) configured to mate electrically and mechanically with the microphone connector 206. The flexible boom 205 has length and flexibility characteristics that allow the microphone 204 to be easily and optimally positioned near the violin 180 (see FIG. 8), e.g., near one of the violin sound holes. The microphone subassembly 104 further includes an optional foam cover 207 that may be placed over the microphone 204 to minimize the adverse effects of wind and vibration on the amplified violin sound. In an alternative embodiment, electrical signals from the microphone 204 may pass through a cable (not shown) external to the flexible boom 205 configured for direct connection to the connector 105.

Figure 2:
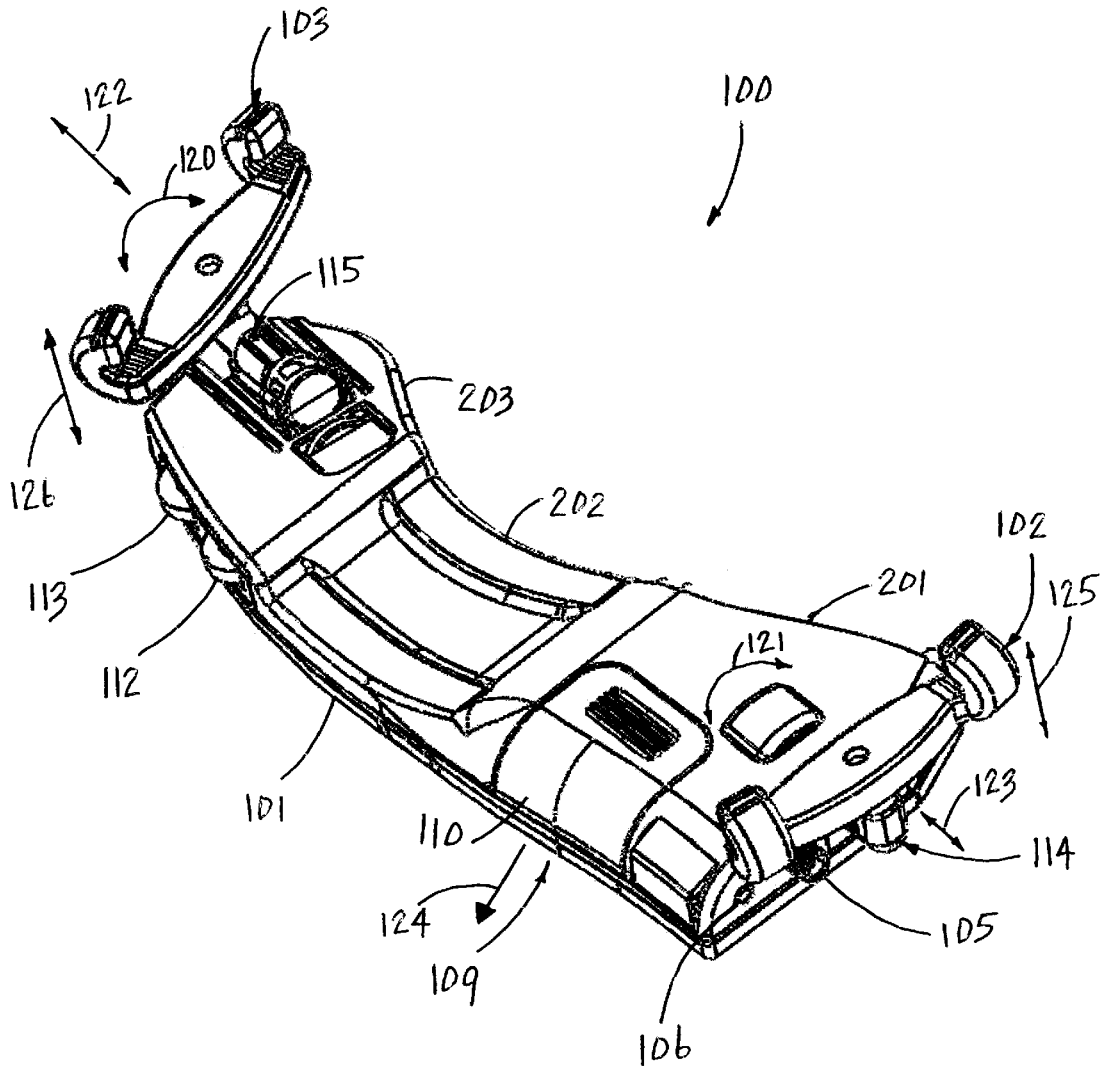
FIG. 2 is a second perspective view of the violin shoulder rest of FIG. 1.

FIG. 2 depicts a second perspective view of the violin shoulder rest 100. In the illustrated embodiment, both of the securement mechanisms 114–115 are configured to allow pivotal movement of the clamping members 102–103, respectively, as depicted by directional arrows 120–121, thereby facilitating the optimal positioning of the violin relative to the violin player's body. Further, one or both of the securement mechanisms 114–115 are configured to allow longitudinal movement of the clamping members 102–103, respectively, as depicted by directional arrows 122–123, for fine adjustment of the spacing between the clamps 102–103. As shown in FIG. 2, the violin shoulder rest 100 may also include at least one second signal input connector, e.g., a signal input connector 106 disposed next to the signal input connector 105. For example, the signal input connector 106 may be configured to mate with a connection to a piezoelectric bridge transducer (not shown) operatively connected to the violin bridge, or any other suitable signal input device. Accordingly, depending on the embodiment, the violin shoulder rest 100 may be provided with the microphone subassembly 104 and the cooperating electromechanical input connector 105, the discrete electrical signal input connector 106, or both.

Figure 3:
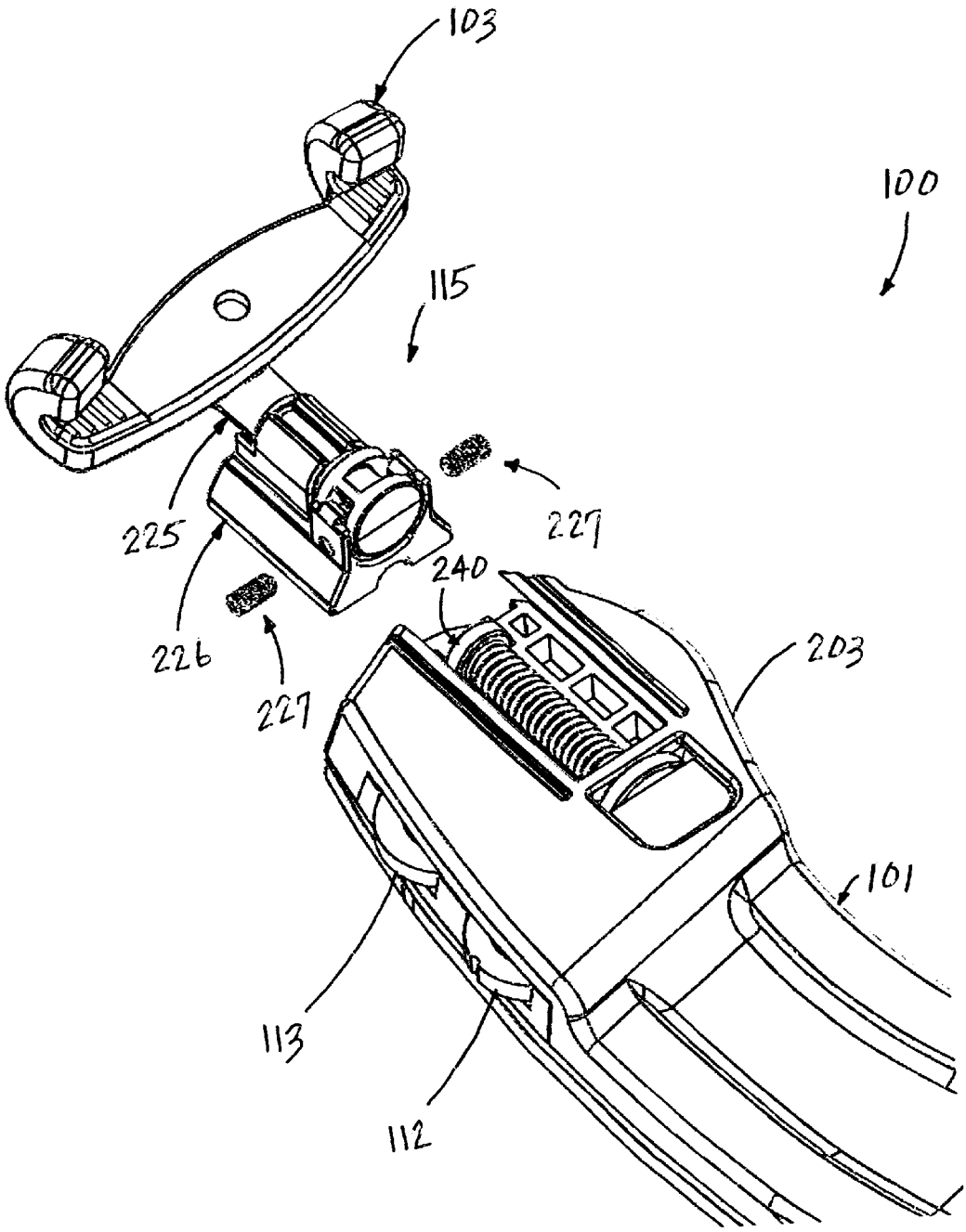
FIG. 3 is a first exploded view of a first securement mechanism for securing the first clamping member to the elongated base of FIG. 1.
Figure 4:
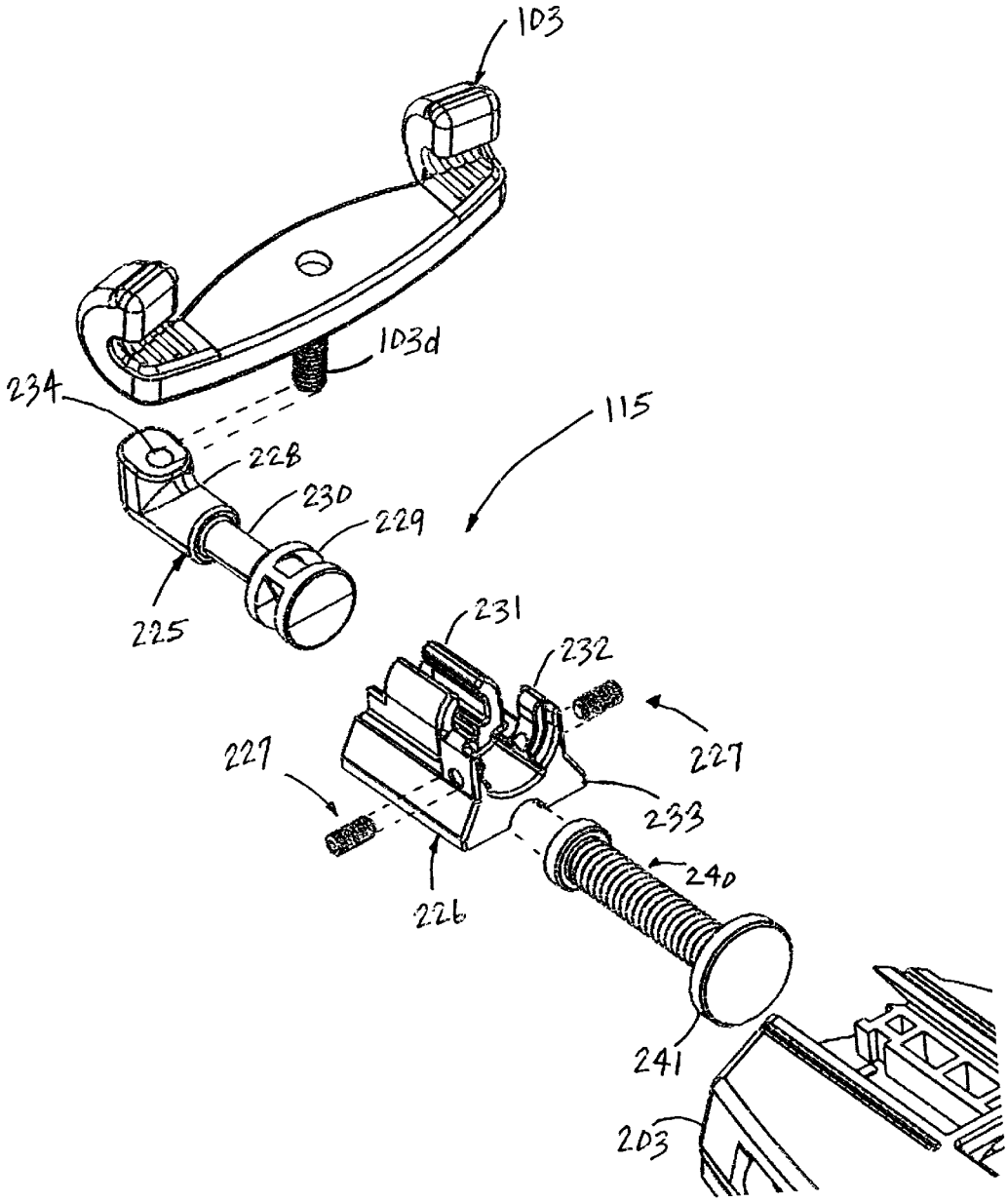
FIG. 4 is a second exploded view of the securement mechanism of FIG. 3.

FIGS. 3–4 depict exploded views of the securement mechanism 115 for securing the clamping member 103 to the elongated base 101 of the violin shoulder rest 100 (see FIG. 1). It is understood that the securement mechanism 114 securing the clamping member 102 to the base 101 is substantially like the securement mechanism 115. As shown in FIGS. 3–4, the securement mechanism 115 includes a pivot joint 225, a pivot joint support 226, and a plurality of pivot adjustment screws 227. The pivot joint 225 includes a right-angled end portion 228, a cylindrical stop mechanism 229 at the opposite end of the pivot joint 225, and a cylindrical portion 230 connecting the end portion 228 to the stop mechanism 229. The end portion 228 is configured for rotatably holding the clamping member 103. In the illustrated embodiment, the clamping member 103 includes a screw portion 103*d*, and the end portion 228 includes a threaded hole 234 configured to receive the screw portion 103*d*. In this way, the pivot joint 225 can securely hold the clamping member 103, while allowing the spacing between the clamping member 103 and the elongated base 101 to be adjusted (as indicated by directional arrows 125) by rotating the clamp 103 clockwise or counter-clockwise.

The pivot joint support 226 of the securement mechanism 115 includes a first split sleeve 231 configured to at least partially fit over the cylindrical portion 230 of the pivot joint 225, and a second split sleeve 232 configured to at least partially fit over the stop mechanism 229 of the pivot joint 225. In the preferred embodiment, the pivot joint support 226 is configured to allow the cylindrical portion 230 to be snap-fit into the first sleeve 231, allowing limited rotation of the cylindrical portion 230 and the stop mechanism 229 within the respective sleeves 231–232. In this way, the securement mechanism 115 allows pivotal movement of the clamping member 103, as depicted by the directional arrows 120 (see FIG. 2).

Figure 5B:
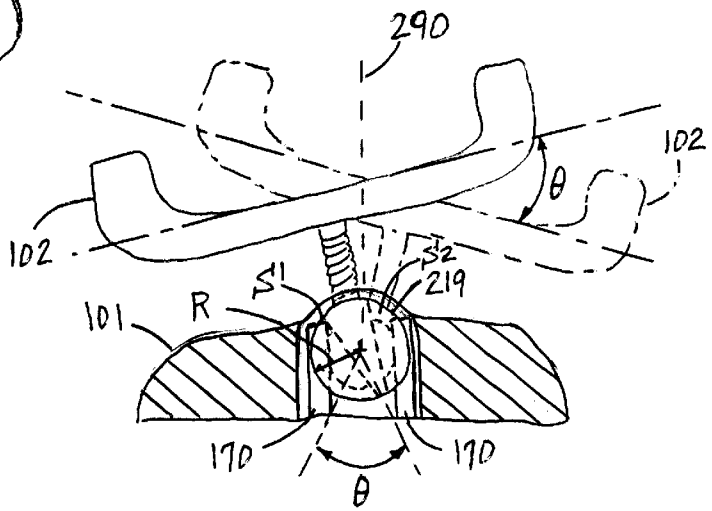
FIG. 5*b* is a cross-sectional view of the elongated base showing a portion of the securement mechanism of FIG. 5*a;*
Figure 5A:
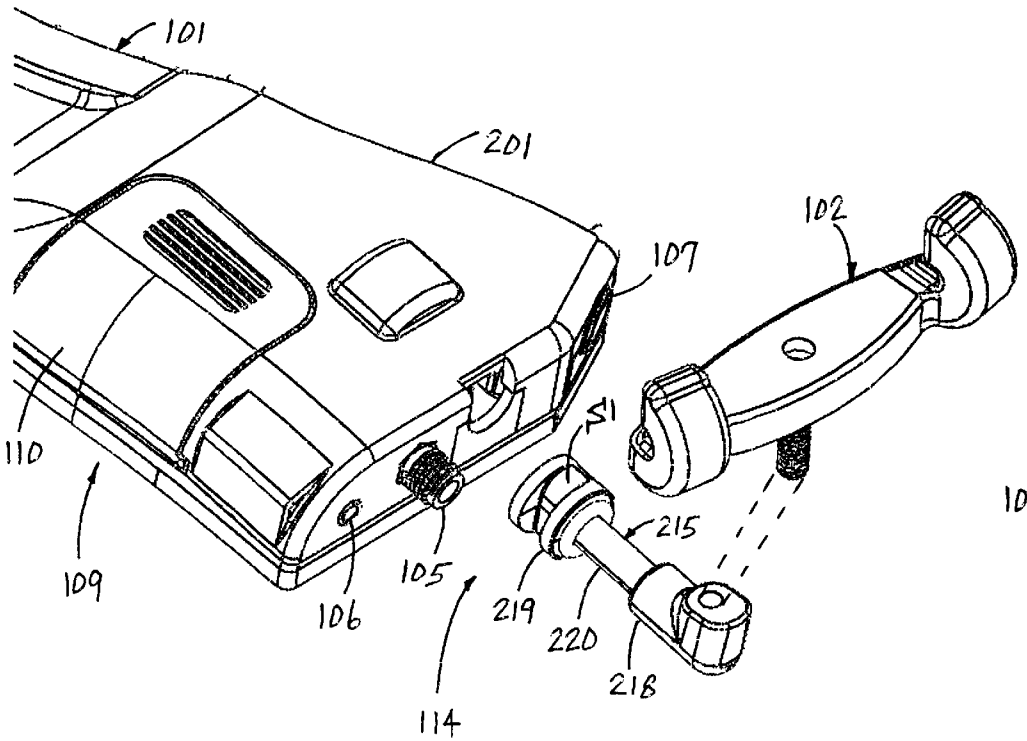
FIG. 5*a* is an exploded view of a second securement mechanism for securing the second clamping member to the elongated base of FIG. 1.

FIG. 5*a* depicts an exploded view of the securement mechanism 114 securing the clamping member 102 to the elongated base 101 of the violin shoulder rest 100 (see FIG. 1). As shown in FIG. 5*a*, the securement mechanism 114 includes a pivot joint 215, which is substantially similar to the pivot joint 225 of the securement mechanism 115. Moreover, the pivot joint 215 is configured to securely hold the clamping member 102 in substantially the same way that the pivot joint 225 holds the clamping member 103, allowing the spacing between the clamping member 102 and the elongated base 101 to be adjusted (as indicated by directional arrows 125) by rotating the clamp 102 clockwise or counter-clockwise. It is noted that a pivot joint support 172 (see FIG. 10) is incorporated within the elongated base 101 to allow limited rotation of the pivot joint 215, thereby allowing pivotal movement of the clamping member 102, as depicted by the directional arrows 121 (see FIG. 2). As indicated by the directional arrows 120–123 and 125–126, the securement mechanisms 114–115 are configured to allow the violin player to adjust the clamping members 102–103, respectively, in at least three degrees-of-freedom.

FIG. 5*b* is a cross-sectional end view of the base 101, showing the stop mechanism 219. It is understood that the stop mechanism 229 of the pivot joint 225 (see FIGS. 3–4) is substantially like the stop mechanism 219. As shown in FIG. 5*b*, the stop mechanism 219 has a radius R, and a pair of slots S1–S2 (see also FIGS. 5*a* and 10) formed around a partial circumference of the mechanism 219. Moreover, the stop mechanism 219 is disposed within the base housing 101 so that fixed projections 170 of the base 101 are at least partially disposed in the respective slots S1–S2. As a result, the fixed projections 170 limit the range of pivotal rotation of the stop mechanism 219 to an angle θ by impinging on opposing ends of the respective slots S1–S2.

It is appreciated that when the stop mechanism 229 (see FIGS. 3–4) is operatively disposed in the second sleeve 232 of the pivot joint support 226, the adjustment screws 227 perform substantially the same function as the fixed projections 170, with the exception that the screws 227 allow the range of pivot rotation of the stop mechanism 229 to be adjusted. In the preferred embodiment, the screws 227 and the fixed projections 170 allow pivotal rotation of the respective stop mechanisms 229 and 219 within the angle θ ranging from about −10° to about 40° (or a predetermined subset thereof) relative to a reference axis 290 substantially perpendicular to the base 101. It is noted that the adjustment screws 227 may also be employed to lock the stop mechanism 229 at a predetermined angle within the total range of about 50°.

Figure 9:
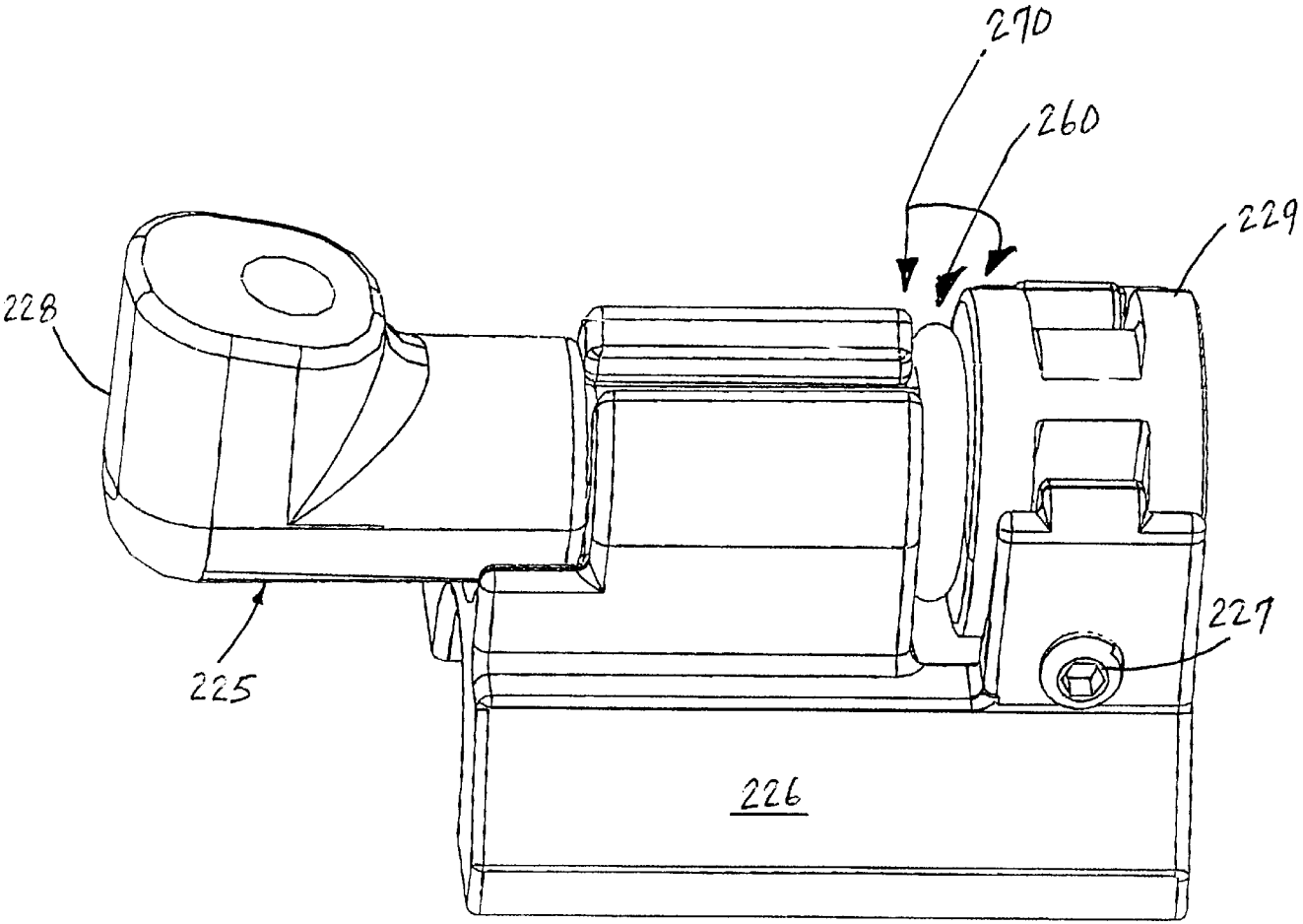
FIG. 9 is a perspective view of a first friction element employed with the securement mechanism of FIG. 3.

In the preferred embodiment, friction elements 260 and 262 (see FIGS. 9–10) are employed to facilitate rotation of the pivot joints 225 and 215, respectively, to predetermined angular positions. In the illustrated embodiment, the friction elements 260 and 262 comprise stationary O-rings, which make contact with friction surfaces 270 and 272, respectively.

As shown in FIGS. 3–4, the violin shoulder rest 100 further includes an adjustment screw 240 that engages with a dove-tail clamp portion 233 of the pivot joint support 226 of the securement mechanism 115. The adjustment screw 240 can be manually adjusted, e.g., via a thumb-wheel 241, to allow longitudinal movement of the clamping member 103, as depicted by the directional arrows 122, for fine adjustment of the spacing between the clamps 102–103.

As described above, the violin shoulder rest 100 may include both the first and second signal input connectors 105–106 (see FIG. 2). Accordingly, the elongated base 101 is configured to accommodate electronic circuitry that may be employed to amplify or otherwise process the electrical signals provided via the input connectors 105–106. It is understood that such electrical signals are provided by input devices such as the microphone subassembly 104, the piezoelectric bridge transducer (not shown), or any other suitable input device.

Specifically, the elongated base 101 (see FIG. 1) includes a pair of substantially rigid hollow enclosures 201 and 203 disposed at opposing ends of the base 101, and the flexible section 202 disposed between the rigid enclosures 201 and 203. In the preferred embodiment, the flexible section 202 is also hollow. For example, the flexible section and the enclosures 201–203 may be made of a suitable high-impact plastic, or any other suitable material. The rigid enclosures 201 and 203 are configured to house the above-mentioned amplification and/or signal processing circuitry, and the flexible section 202 is configured to serve as a conduit for conductors passing between the circuitry, connectors, and controls disposed within the opposing rigid enclosures 201 and 203.

Figure 6:
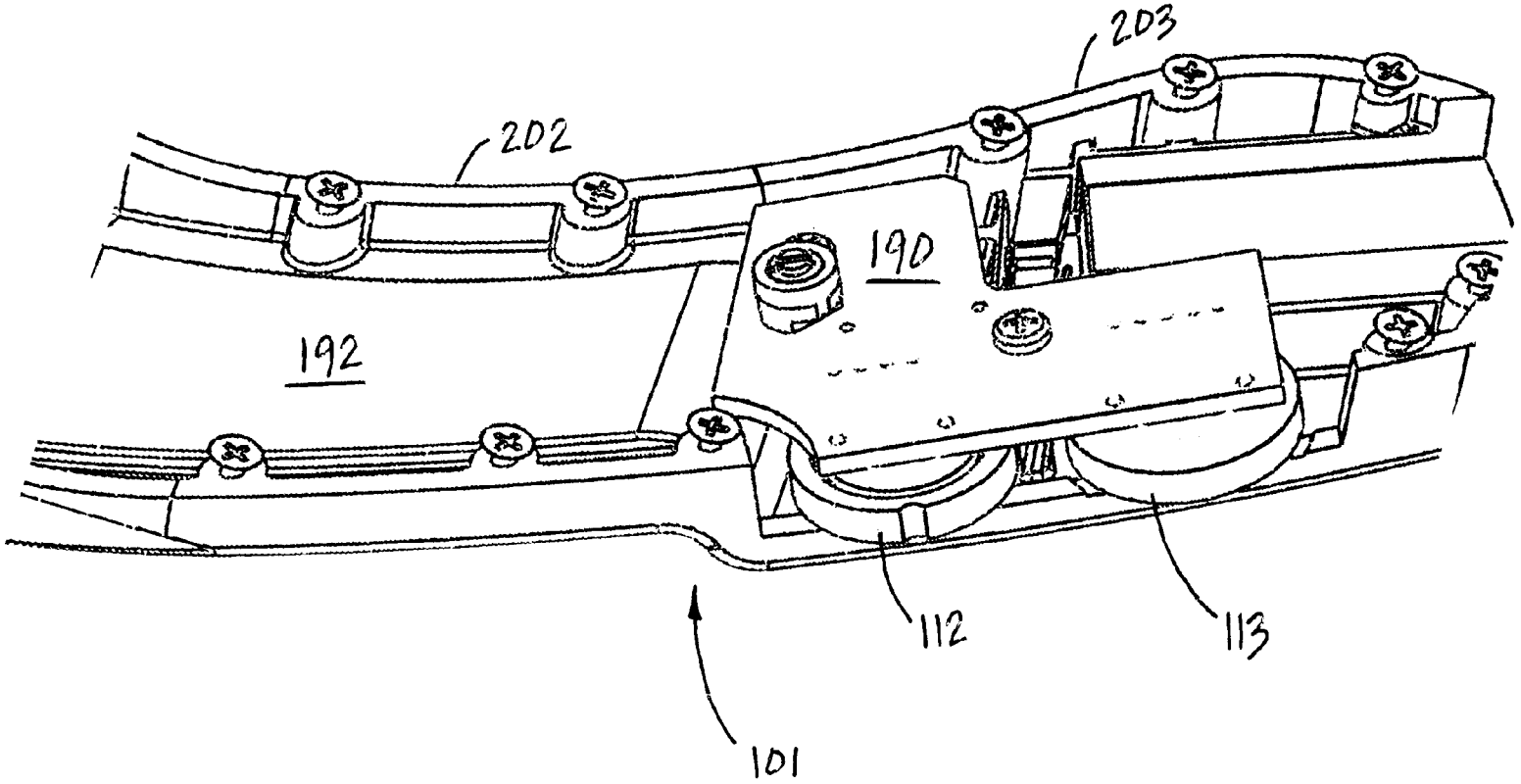
FIG. 6 is a perspective view of the interior of a first rigid hollow enclosure, and the interior of a flexible hollow mid-section, of the elongated base of FIG. 1.
Figure 7:
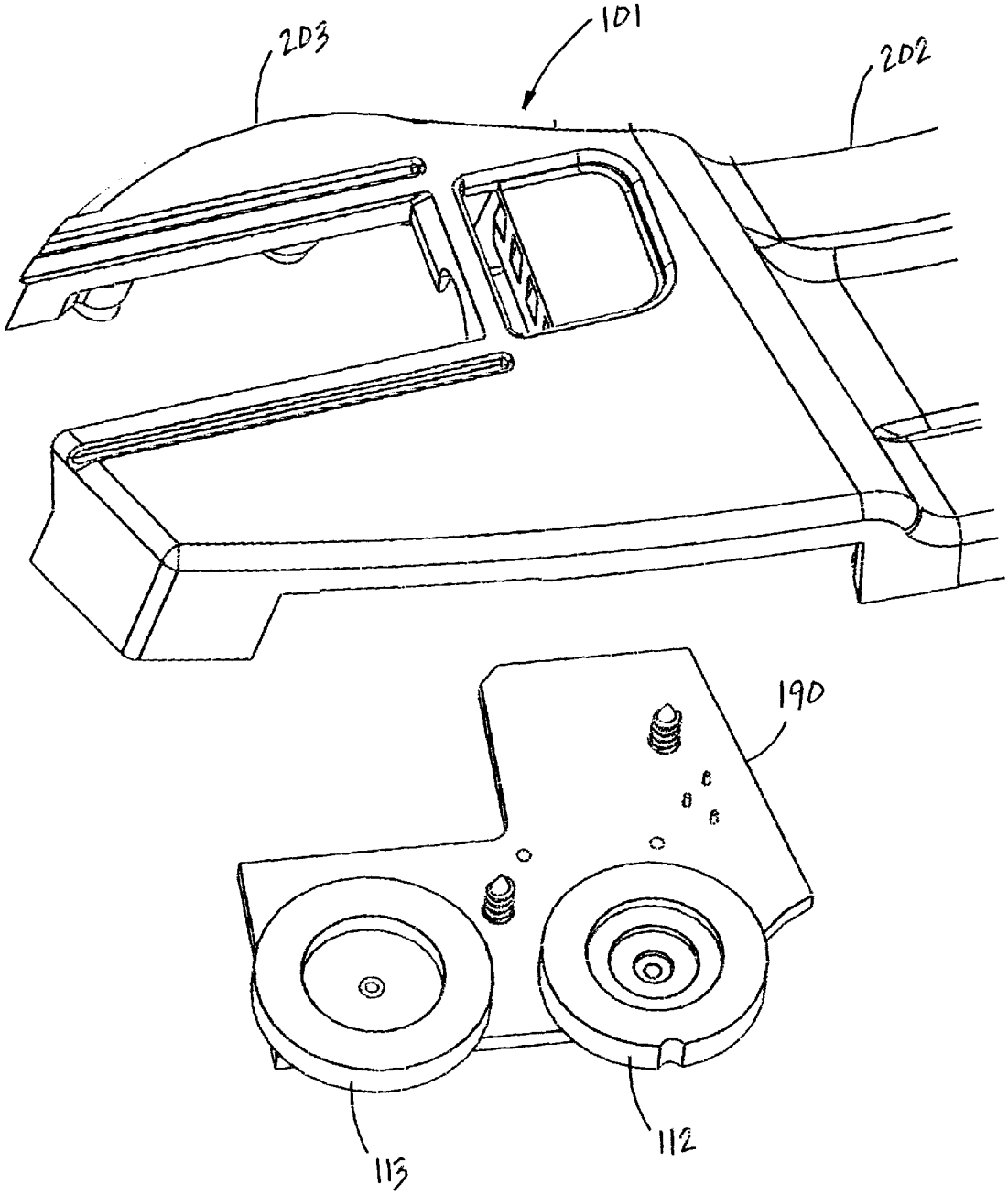
FIG. 7 is an exploded view of the elongated base of FIG. 6.

FIGS. 6–7 depict perspective views of the interior of the rigid enclosure 203 and the flexible section 202. As shown in FIGS. 6–7, the rigid enclosure 203 is configured to house a Printed Circuit Board (PCB) 190, which may include a plurality of active/passive integrated and/or discrete electrical/electronic components (not shown). Further, the flexible section 202 serves as a conduit for a ribbon cable 192 operatively coupled between the PCB 190 and, e.g., an optional second PCB (not shown) similarly disposed in the housing of the rigid enclosure 201.

For example, the circuitry implemented on the PCB 190 may include pre-amplification, frequency adjustment, or any other suitable signal processing capability, either pre-set or adjustable via controls 112–113. Further, the circuitry and the controls 112–113 may be employed to mix the electrical signal inputs provided at the signal inputs 105–106, and/or to adjust the resulting sound volume and tone. The amplified/processed electrical signal(s) are then provided to a signal output connector 107 (see FIG. 5) for subsequent amplification and processing. For example, the signal output connector 107 may comprise a standard ¼-inch output jack. It is noted that the circuitry implemented on one or more of the PCBs within the rigid enclosures 201 and 203, e.g., the PCB 190, may comprise a wireless transmitter circuit to obviate the need for a cable (not shown) connected to the output connector 107. For example, such a wireless transmitter circuit may generate a low-power Radio Frequency (RF) signal or similar signal. In this case, the signal output connector 107 may be provided as a transmitter.

Figure 10:
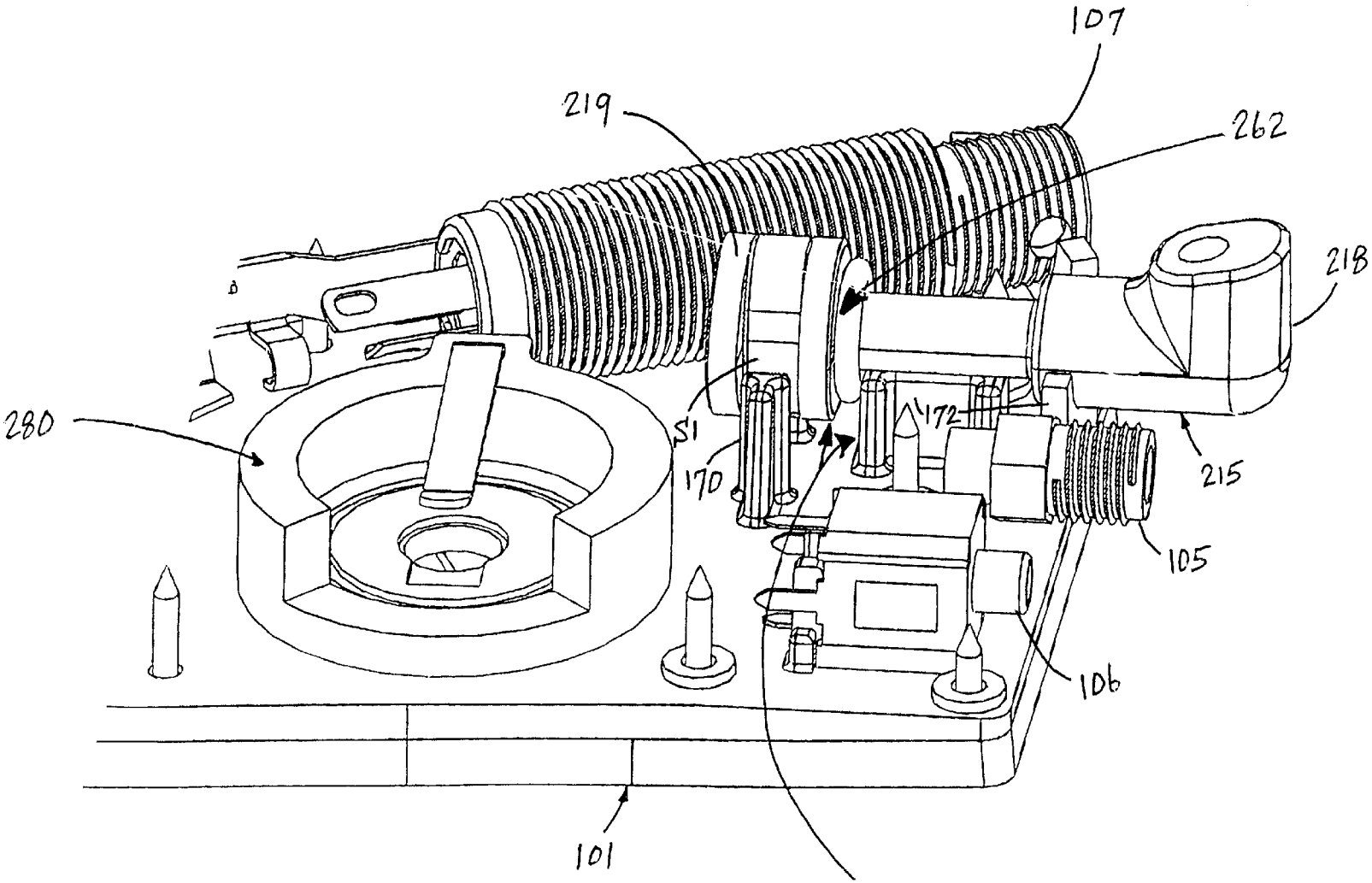
FIG. 10 is a perspective view of the interior of a second rigid hollow enclosure showing a second friction element employed with the securement mechanism of FIG. 5*a*.

As shown in FIGS. 1–2, one embodiment of the rigid enclosure 201 of the violin shoulder rest 100 includes a compartment 109 for housing a battery to power the active electrical/electronic circuit components. In the illustrated embodiment, the battery compartment 109 includes a door 110 that may be slid open, as depicted by the directional arrow 124, to install or replace the battery, which may comprise a disk battery or any other suitable battery for powering the amplification and/or signal processing circuitry. As shown in FIG. 10, the violin shoulder rest 100 includes a holder 280 for the battery.

Having described the above illustrative embodiments, other alternative embodiments or variations may be made. For example, such alternative embodiments of the violin shoulder rest 100 (see FIG. 1) may include only a single signal input, only passive controls, or no on-board electronics. In such alternative embodiments, the microphone subassembly 104 would be mounted to the elongated base 101, as illustrated in FIG. 1, however, any amplification or other processing of the signal provided by the microphone 204 would typically be performed external to the violin shoulder rest. For example, the violin shoulder rest may include a direct electrical signal path between the input connector 105 and the output connector 107.

It will further be appreciated by those of ordinary skill in the art that modifications to and variations of the above-described violin shoulder rest may be made without departing from the inventive concepts disclosed herein. Accordingly, the invention should not be viewed as limited except as by the scope and spirit of the appended claims.

What is claimed is:

1. A shoulder rest for use with a violin or similar stringed instrument, comprising:

an elongated base configured to conform to a user's shoulder, the elongated base including opposing end portions and an intermediate portion disposed between the opposing end portions;

a pair of clamping members secured to the elongated base, one at each of the opposing end portions, the clamping members being configured to clamp the shoulder rest to a respective violin or similar stringed instrument by engaging opposing side portions thereof; and a microphone subassembly including a flexible boom having a distal end and a proximate end, the microphone subassembly further including a microphone attached to the distal end of the boom, the proximate end of the boom being connected to the elongated base at a respective one of the opposing end portions, wherein the flexible boom has a length sufficient to allow the user to optimally position the microphone adjacent the violin or similar stringed instrument.

2. The shoulder rest of claim 1 further including an output signal connection secured to the base and at least one conductor operatively coupled from the microphone to the output signal connection.

3. The shoulder rest of claim 2 wherein the combination of the boom and the base is configured as a conduit for the at least one conductor.

4. The shoulder rest of claim 1 wherein at least one of the opposing end portions and the intermediate portion of the base includes at least one input signal connection, at least one output signal connection, and at least one electrical signal path disposed within the base and configured to convey at least one electrical signal from the input signal connection to the output signal connection, and wherein the microphone subassembly further includes a connector coupled to the proximate end of the boom and configured to mate with the at least one input signal connection, the microphone being operatively coupleable to the at least one input signal connection via the microphone subassembly connector.

5. The shoulder rest of claim 4 wherein the at least one electrical signal path comprises circuitry for processing the at least one electrical signal to produce at least one processed output signal.

6. The shoulder rest of claim 5 wherein the circuitry includes at least one user accessible adjustment mechanism for adjusting at least one parameter of the at least one electrical signal.

7. The shoulder rest of claim 5 wherein the circuitry is selected from the group consisting of pre-amplification circuitry, frequency adjustment circuitry, and wireless transmitter circuitry for transmitting the output signal.

8. The shoulder rest of claim 4 wherein the at least one input signal connection comprises a plurality of input signal connections, the at least one electrical signal path is configured to convey a plurality of electrical signals, and the at least one electrical signal path comprises circuitry for mixing the plurality of electrical signals or a predetermined subset of the electrical signals.

9. The shoulder rest of claim 1 wherein each clamping member is secured to the elongated base by a respective securement mechanism, each securement mechanism being configured to enable the respective clamping member to move in at least two degrees of freedom relative to the base.

10. The shoulder rest of claim 9 wherein the securement mechanism is configured to enable the respective clamping member to be rotated about an axis substantially parallel to the base and perpendicular to a longitudinal axis of the clamping member.

11. The shoulder rest of claim 10 wherein at least one of the securement mechanisms includes an adjustment mechanism for adjusting a range of angular rotation of the clamping member.

12. The shoulder rest of claim 11 wherein the adjustment mechanism includes a friction element for facilitating the adjustment of the range of angular rotation.

13. The shoulder rest of claim 12 wherein the friction element comprises an O-ring.

14. The shoulder rest of claim 11 wherein the range of angular rotation of the clamping member is about 50°.

15. The shoulder rest of claim 11 wherein the range of angular rotation of the clamping member is within about −10° to about +40° relative to a reference axis substantially perpendicular to the base.

16. The shoulder rest of claim 11 wherein the adjustment mechanism is configured to lock the clamping member at a predetermined angle relative to the base.

17. The shoulder rest of claim 9 wherein at least one of the securement mechanisms is configured to enable the respective clamping member to be moved linearly along a longitudinal axis of the base.

18. The shoulder rest of claim 17 wherein the at least one securement mechanism includes a dove-tail clamp configured to enable the respective clamping member to be moved linearly along a longitudinal axis of the base.

19. The shoulder rest of claim 9 wherein at least one of the securement mechanisms is configured to enable the respective clamping member to be adjusted along an axis substantially perpendicular to the base.

20. A method of using a shoulder rest with a violin or similar stringed instrument, comprising the steps of:

clamping the shoulder rest to a respective violin or similar stringed instrument by engaging opposing side portions thereof between a pair of clamping members, the clamping members being secured to an elongated base of the shoulder rest, the elongated base conforming to a user's shoulder, the elongated base including opposing end portions and an intermediate portion disposed between the opposing end portions; and positioning a microphone to a desired position adjacent the violin or similar stringed instrument, the microphone being part of a microphone subassembly including a flexible boom having a distal end and a proximate end, the microphone being attached to the distal end of the boom, the proximate end of the boom being connected to the elongated base at a respective one of the opposing end portions, the flexible boom having a length sufficient to allow the user to optimally position the microphone adjacent the violin or similar stringed instrument.

21. The method of claim 20 further including the step of providing at least one conductor coupled from the microphone to an output signal connection secured to the base.

22. The method of claim 21 further including the step of disposing the at least one conductor in a conduit at least partially formed by the combination of the boom and the base.

23. The method of claim 20 conveying at least one electrical signal from at least one input signal connection to at least one output signal connection by at least one electrical signal path, the input and output signal connections and the at least one electrical signal path being disposed at least partially within the base, the microphone being operatively coupled to the at least one input signal connection.

24. The method of claim 23 further including the step of processing the at least one electrical signal to produce at least one processed output signal by circuitry included in the at least one electrical signal path.

25. The method of claim 24 further including the step of adjusting at least one parameter of the at least one electrical signal by at least one user accessible adjustment mechanism included in the circuitry.

26. The method of claim 24 further including the step of amplifying the at least one electrical signal by a preamplifier included in the circuitry.

27. The method of claim 24 further including the step of transmitting the output signal by a wireless transmitter included in the circuitry.

28. The method of claim 23 further including the step of conveying a plurality of electrical signals by the at least one electrical signal path.

29. The method of claim 28 further including the step of mixing the plurality of electrical signals or a predetermined subset of the electrical signals by circuitry included in the at least one electrical signal path.

30. The method of claim 20 further including the step of adjusting the shoulder rest by moving at least one of the clamping members in at least two degrees of freedom relative to the base by a respective securement mechanism securing the clamping member to the base.

31. The method of claim 30 wherein the adjusting step further includes rotating at least one of the clamping members about an axis substantially parallel to the base and perpendicular to a longitudinal axis of the clamping member.

32. The method of claim 31 wherein the adjusting step further includes rotating the at least one clamping member within a predetermined range of angular rotation.

33. The method of claim 32 wherein the adjusting step includes rotating the at least one clamping member within a range of angular rotation of about 50°.

34. The method of claim 32 wherein the adjusting step includes rotating the at least one clamping member within a range of angular rotation of about −10° to about +40° relative to a reference axis substantially perpendicular to the base.

35. The method of claim 32 further including the step of locking the at least one clamping member at a predetermined angle relative to the base.

36. The method of claim 30 wherein the adjusting step includes moving the at least one clamping member substantially linearly along a longitudinal axis of the base.

37. The method of claim 30 wherein the adjusting step includes adjusting the at least one clamping member along an axis substantially perpendicular to the base.

* * * * *